US011772919B2

(12) United States Patent
Hong et al.

(10) Patent No.: US 11,772,919 B2
(45) Date of Patent: Oct. 3, 2023

(54) BI-DIRECTIONAL PAPER PICKUP MECHANISM

(71) Applicant: Foxlink Image Technology Co., Ltd., New Taipei (TW)

(72) Inventors: I Chuan Hong, New Taipei (TW); Lung Chen, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 161 days.

(21) Appl. No.: 17/567,154

(22) Filed: Jan. 3, 2022

(65) Prior Publication Data

US 2022/0267106 A1 Aug. 25, 2022

(30) Foreign Application Priority Data

Feb. 19, 2021 (TW) ..... 11020184.3

(51) Int. Cl.
*B65H 3/06* (2006.01)

(52) U.S. Cl.
CPC ..... *B65H 3/0669* (2013.01); *B65H 3/0623* (2013.01); *B65H 2403/47* (2013.01); *B65H 2403/55* (2013.01); *B65H 2403/72* (2013.01); *B65H 2403/732* (2013.01); *B65H 2403/942* (2013.01); *B65H 2801/06* (2013.01)

(58) Field of Classification Search
CPC ..... B65H 3/0669; B65H 2403/47; B65H 3/0623; B65H 2403/732; B65H 2403/55; B65H 2403/942; B65H 3/06
USPC ..... 271/116
See application file for complete search history.

(56) References Cited

U.S. PATENT DOCUMENTS 9,309,066 B2 * 4/2016 Yamamoto ..... B65H 3/0684

* cited by examiner

*Primary Examiner* — Jeremy R Severson
(74) *Attorney, Agent, or Firm* — LIN & ASSOCIATES INTELLECTUAL PROPERTY, INC.

(57) ABSTRACT

A bi-directional paper pickup mechanism includes a pickup roller, a fastening structure, an input shaft, a first ratchet element, a second ratchet element, an actuating unit, a first transmission rotor and a second transmission rotor. The pickup roller has an inner space. The fastening structure is disposed in the inner space. The input shaft is accommodated in the inner space, and one end of the input shaft is pivotally connected to the fastening structure. The first ratchet element is mounted around the input shaft. The second ratchet element is mounted around the one end of the input shaft. The actuating unit is fastened around a middle of the input shaft to synchronously rotate with the input shaft. The first transmission rotor is mounted around the one end of the input shaft. The second transmission rotor is mounted around the other end of the input shaft.

18 Claims, 10 Drawing Sheets

BI-DIRECTIONAL PAPER PICKUP MECHANISM

CROSS-REFERENCE TO RELATED APPLICATION

The present application is based on, and claims priority from, Taiwan Patent Application No. 110201843, filed Feb. 19, 2021, the disclosure of which is hereby incorporated by reference herein in its entirety.

BACKGROUND OF THE INVENTION

1. Field of the Invention

The present invention generally relates to a bi-directional paper pickup mechanism which changes a power transmitting status between an input shaft and a pickup roller, and more particularly to a bi-directional paper pickup mechanism which transmits a driving force from a clockwise rotation or an anticlockwise rotation of an input shaft to a pickup roller, and blocks a transmission force from the pickup roller by virtue of making the pickup roller idle.

2. The Related Art

Referring to FIG. 10, a conventional paper pickup mechanism includes a pickup roller 101, a separation unit 102, a feeding roller 103 and a motor. The pickup roller 101 feeds paper forward. Because the paper is repeatedly fed at times, the paper is overlapped. The separation unit 102 blocks the overlapped paper by a friction force. Besides, in order to make the paper keep flat in the process of feeding the paper, the feeding roller 103 is disposed downstream, and a rotation speed of the feeding roller 103 is faster than a rotation speed of the pickup roller 101. The conventional paper pickup mechanism exerts a tension force on the paper via a rotation speed difference between the pickup roller 101 and the feeding roller 103, so that the paper keeps flat. Furthermore, the pickup roller 101 is generally equipped with a one-way torque limiter (not shown). The torque limiter transfers power from the motor to the pickup roller 101, and when the pickup roller 101 is pulled by the paper to be accelerated, the torque limiter idles. Thus the paper is avoided from being damaged on account of an excessive tension force.

However, the torque limiter of the conventional paper pickup mechanism idles at the time of the pickup roller 101 being pulled by the paper, so when an error is occurred in the process of feeding the paper, the conventional paper pickup mechanism is unable to feed out the paper automatically by way of the motor rotating reversely. As a result, a user must start the conventional paper pickup mechanism manually and must withdraw the abnormally fed paper manually.

Therefore, it is necessary to provide a bi-directional paper pickup mechanism, the bi-directional paper pickup mechanism idles at the time of paper being pulled to be accelerated, and simultaneously, the bi-directional paper pickup mechanism is able to bidirectionally feed the paper upstream and downstream.

SUMMARY OF THE INVENTION

An object of the present invention is to provide a bi-directional paper pickup mechanism. The bi-directional paper pickup mechanism includes a pickup roller, a fastening structure, an input shaft, a first ratchet element, a second ratchet element, an actuating unit, a first transmission rotor and a second transmission rotor. An inside of the pickup roller has an inner space extending along an axis direction of the pickup roller. The inner space penetrates through two opposite ends of the pickup roller. The fastening structure is disposed in the inner space. The input shaft is accommodated in the inner space, and one end of the input shaft is pivotally connected to the fastening structure. The first ratchet element is mounted around the input shaft. The other end of the input shaft and the first ratchet element are fastened to one end of the pickup roller. The second ratchet element is mounted around the one end of the input shaft. The one end of the input shaft and the second ratchet element are fastened to the other end of the pickup roller. The actuating unit is fastened around a middle of the input shaft to synchronously rotate with the input shaft. The actuating unit has a first actuating surface and a second actuating surface. The first transmission rotor is mounted around the one end of the input shaft, and the first transmission rotor is positioned between the first ratchet element and the first actuating surface. Two opposite ends of the first transmission rotor have a first actuating end and a first ratchet end. The first actuating end is disposed adjacent to the first actuating surface. The first ratchet end is disposed adjacent to an inner end surface of the first ratchet element. The second transmission rotor is mounted around the other end of the input shaft. The second transmission rotor is positioned between the second ratchet element and the second actuating surface. Two opposite ends of the second transmission rotor have a second actuating end and a second ratchet end. The second actuating end is disposed adjacent to the second actuating surface. The second ratchet end is disposed adjacent to an inner end surface of the second ratchet element. The first actuating surface and the first actuating end are cooperated to form a first conversion unit, when the input shaft rotates towards a paper feeding direction, the first transmission rotor rotates towards the paper feeding direction, the first transmission rotor moves towards the first ratchet element under an action of the first conversion unit. The first ratchet element is cooperated with the first ratchet end to form a second conversion unit, when the input shaft rotates towards a paper receding direction, the input shaft drives the first transmission rotor to rotate towards the paper receding direction, the first transmission rotor breaks away from the first ratchet element under an action of the second conversion unit. The second actuating surface is cooperated with the second actuating end to form a third conversion unit, when the input shaft rotates towards the paper feeding direction, the second transmission rotor breaks away from the second ratchet element under an action of the third conversion unit. The second ratchet element is cooperated with the second ratchet end to form a fourth conversion unit, when the input shaft rotates towards the paper receding direction, the input shaft drives the second transmission rotor to move towards the second ratchet element under an action of the fourth conversion unit, the second transmission rotor is engaged with the second ratchet element.

Another object of the present invention is to provide a bi-directional paper pickup mechanism. The bi-directional paper pickup mechanism includes a pickup roller, an input shaft, a first ratchet element, a second ratchet element, an actuating unit, a first transmission rotor and a second transmission rotor. An inside of the pickup roller has an inner space penetrating through two opposite ends of the pickup roller. The input shaft is accommodated in the inner space. One end of the input shaft is received in the inner space. The first ratchet element is mounted around the other end of the input shaft. The other end of the input shaft and the first ratchet element are received in the inner space. The other end of the input shaft and the first ratchet element are fastened to one end of the pickup roller. The second ratchet element is mounted around the one end of the input shaft. The second ratchet element is received in the inner space. The one end of the input shaft and the second ratchet element are fastened to the other end of the pickup roller. The actuating unit is fastened around a middle of the input shaft to synchronously rotate with the input shaft. The actuating unit has a first actuating surface and a second actuating surface. The first transmission rotor is mounted around the one end of the input shaft, and the first transmission rotor is positioned between the first ratchet element and the first actuating surface. Two opposite ends of the first transmission rotor have a first actuating end and a first ratchet end. The first actuating end is disposed adjacent to the first actuating surface. The first ratchet end is disposed adjacent to an inner end surface of the first ratchet element. The second transmission rotor is mounted around the other end of the input shaft. The second transmission rotor is positioned between the second ratchet element and the second actuating surface. Two opposite ends of the second transmission rotor have a second actuating end and a second ratchet end. The second actuating end is disposed adjacent to the second actuating surface. The second ratchet end is disposed adjacent to an inner end surface of the second ratchet element. When the input shaft rotates towards a paper feeding direction, the first actuating surface rotates along the first actuating end to push the first transmission rotor to move towards the first ratchet element, the first ratchet end is matched with the first ratchet element, the second actuating end abuts against the second actuating surface, the second transmission rotor breaks away from the second ratchet element. When the input shaft rotates towards a paper receding direction, the first actuating end abuts against the first actuating surface, the first transmission rotor breaks away from the first ratchet element, the second actuating surface rotates along the second actuating end to push the second transmission rotor to move towards the second ratchet element, the second ratchet end is matched with the second ratchet element.

Another object of the present invention is to provide a bi-directional paper pickup mechanism. The bi-directional paper pickup mechanism includes a pickup roller, a fastening structure, an input shaft, a first ratchet element, a second ratchet element, an actuating unit, a first transmission rotor and a second transmission rotor. An inside of the pickup roller has an inner space penetrating through two opposite ends of the pickup roller. The fastening structure is disposed in the inner space. The input shaft is accommodated in the inner space, and one end of the input shaft is pivotally connected to the fastening structure. The first ratchet element is mounted around the input shaft. The first ratchet element is fastened to one end of the pickup roller. The first ratchet element includes a first hollow shaft. The first hollow shaft extends towards the one end of the input shaft. The second ratchet element is mounted around the one end of the input shaft, and the second ratchet element is fastened to the other end of the pickup roller. The fastening structure is disposed in the other end of the pickup roller. The actuating unit is fastened around a middle of the input shaft to synchronously rotate with the input shaft. The actuating unit has a first actuating surface and a second actuating surface. The first transmission rotor is mounted around the one end of the input shaft, and the first transmission rotor is positioned between the first ratchet element and the first actuating surface. Two opposite ends of the first transmission rotor have a first actuating end and a first ratchet end. The first actuating end is disposed adjacent to the first actuating surface. The first ratchet end is disposed adjacent to an inner end surface of the first ratchet element. The first transmission rotor has a first shaft hole transversely penetrating through two opposite ends of the first transmission rotor. The first shaft hole extends along an axis direction of the input shaft. The first hollow shaft is pivotally mounted in the first shaft hole. The second transmission rotor is mounted around the other end of the input shaft. The second transmission rotor is positioned between the second ratchet element and the second actuating surface. Two opposite ends of the second transmission rotor have a second actuating end and a second ratchet end. The second actuating end is disposed adjacent to the second actuating surface. The second ratchet end is disposed adjacent to an inner end surface of the second ratchet element. The fastening structure has a second hollow shaft. The second hollow shaft extends along the axis direction of the input shaft. The second transmission rotor has a second shaft hole. The second shaft hole extends along the axis direction of the input shaft. The second shaft hole penetrates through two opposite ends of the second transmission rotor. The second hollow shaft is pivotally mounted in the second shaft hole. When the input shaft rotates towards a paper feeding direction, the first transmission rotor rotates towards the paper feeding direction, the first transmission rotor moves towards the first ratchet element, the second transmission rotor breaks away from the second ratchet element, when the input shaft rotates towards a paper receding direction, the input shaft drives the first transmission rotor to rotate towards the paper receding direction, the first transmission rotor breaks away from the first ratchet element, the input shaft drives the second transmission rotor to move towards the second ratchet element, the second transmission rotor is engaged with the second ratchet element.

As described above, the pickup roller feeds paper or recedes the paper by the actions of the first conversion unit, the second conversion unit, the third conversion unit and the fourth conversion unit, so the bi-directional paper pickup mechanism is able to bidirectionally feed the paper upstream and downstream.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
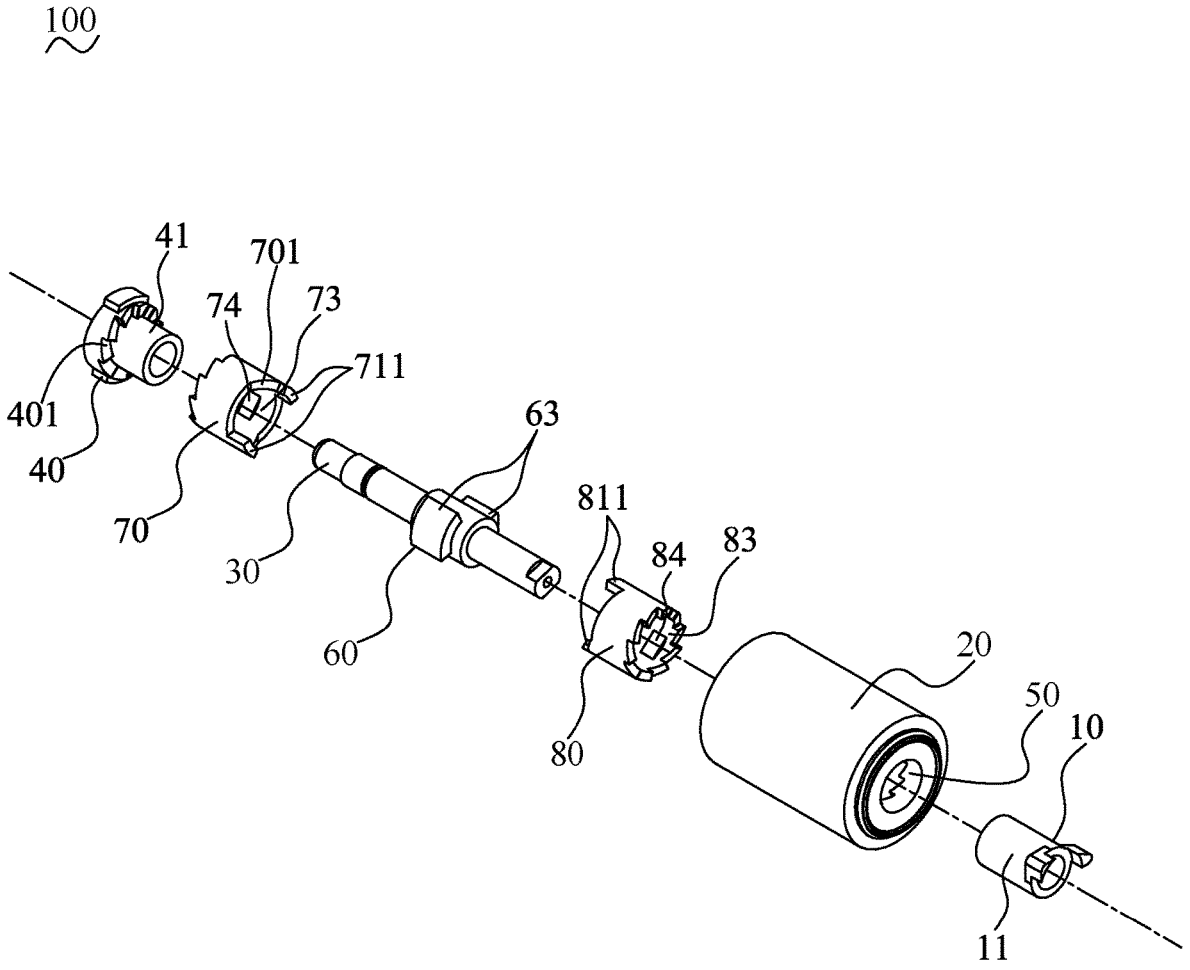
FIG. 1 is an exploded view of a bi-directional paper pickup mechanism in accordance with the present invention.
Figure 2:
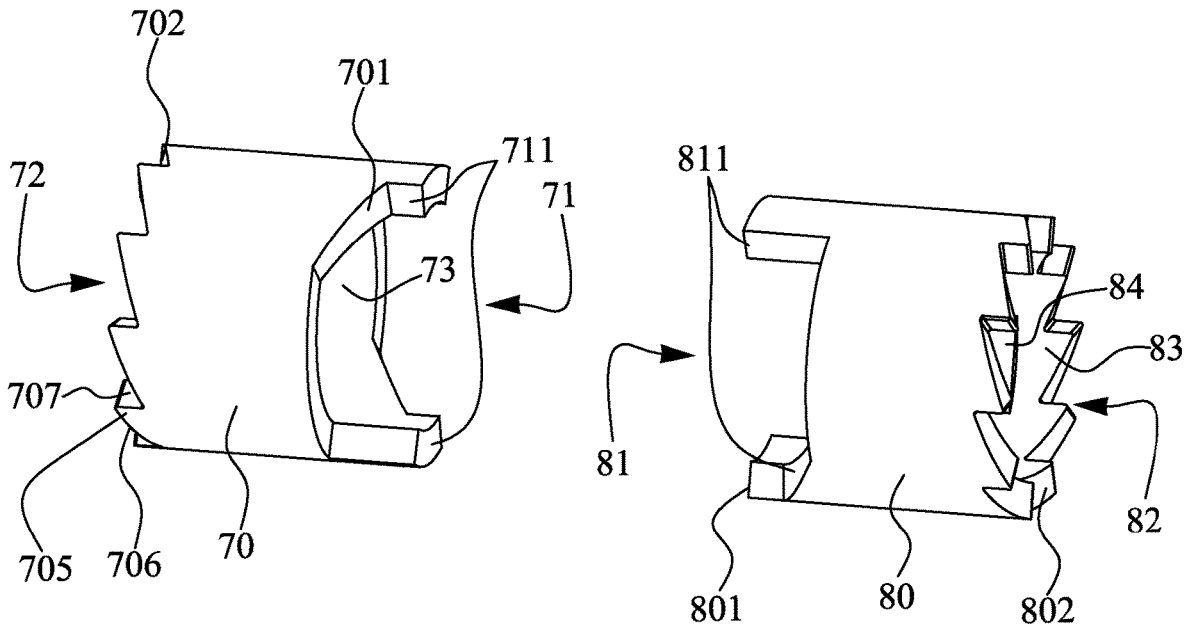
FIG. 2 is a partially exploded view of the bi-directional paper pickup mechanism showing a first transmission rotor and a second transmission rotor of the bi-directional paper pickup mechanism in accordance with the present invention.

Referring to FIG. 1, a bi-directional paper pickup mechanism 100 in accordance with the present invention is shown. The bi-directional paper pickup mechanism 100 includes a fastening structure 10, a pickup roller 20, an input shaft 30, a first ratchet element 40, a second ratchet element 50, an actuating unit 60, a first transmission rotor 70 and a second transmission rotor 80. In the present invention, a paper feeding direction is a direction in which the bi-directional paper pickup mechanism 100 feeds paper from a paper inlet to a paper outlet. A paper receding direction is a direction in which the bi-directional paper pickup mechanism 100 feeds the paper from the paper outlet to the paper inlet. The paper feeding direction is opposite to the paper receding direction.

Referring to FIG. 1 to FIG. 5, an inside of the pickup roller 20 has an inner space 21 extending along an axis direction of the pickup roller 20. The inner space 21 penetrates through two opposite ends of the pickup roller 20. The fastening structure 10 is disposed in the inner space 21. An outer end of the fastening structure 10 is exposed out of the pickup roller 20. The input shaft 30 is accommodated in the inner space 21, and two opposite ends of the input shaft 30 are exposed out of the two opposite ends of the pickup roller 20. One end of the input shaft 30 is pivotally connected to the fastening structure 10. The input shaft 30 is rotatable. The second ratchet element 50 is mounted around the one end of the input shaft 30. The one end of the input shaft 30 and the second ratchet element 50 are received in the inner space 21.

The first ratchet element 40 is mounted around the other end of the input shaft 30. The other end of the input shaft 30 and the first ratchet element 40 are received in the inner space 21. The other end of the input shaft 30 and the first ratchet element 40 are fastened to one end of the pickup roller 20, and the other end of the input shaft 30 and the first ratchet element 40 are connected to the one end of the pickup roller 20. The one end of the input shaft 30 and the second ratchet element 50 are received in the other end of the pickup roller 20. The one end of the input shaft 30 and the second ratchet element 50 are fastened to the other end of the pickup roller 20, and the one end of the input shaft 30 and the second ratchet element 50 are connected to the other end of the pickup roller 20. The actuating unit 60 is fastened around a middle of the input shaft 30 to synchronously rotate with the input shaft 30. The actuating unit 60 has a first actuating surface 61 and a second actuating surface 62.

The first transmission rotor 70 is mounted around the one end of the input shaft 30, and the first transmission rotor 70 is positioned between the first ratchet element 40 and the first actuating surface 61 of the actuating unit 60. Two opposite ends of the first transmission rotor 70 have a first actuating end 71 and a first ratchet end 72. The first ratchet end 72 is opposite to the first actuating end 71. The first actuating end 71 is disposed adjacent to the first actuating surface 61 of the actuating unit 60. The first ratchet element 40 has an inner end surface 401. The first ratchet end 72 is disposed adjacent to the inner end surface 401 of the first ratchet element 40.

The second transmission rotor 80 is mounted around the other end of the input shaft 30. The second transmission rotor 80 is positioned between the second ratchet element 50 and the second actuating surface 62. Two opposite ends of the second transmission rotor 80 have a second actuating end 81 and a second ratchet end 82. The second ratchet end 82 is opposite to the second actuating end 81. The second actuating end 81 is disposed adjacent to the second actuating surface 62 of the actuating unit 60. The second ratchet end 82 is disposed adjacent to an inner end surface 501 of the second ratchet element 50.

The first ratchet element 40 includes a first hollow shaft 41. The first hollow shaft 41 extends towards the one end of the input shaft 30. The first hollow shaft 41 extends along an axis direction of the input shaft 30. A middle of the first transmission rotor 70 has a first shaft hole 73 transversely penetrating through two opposite ends of the first transmission rotor 70. The first shaft hole 73 extends along the axis direction of the input shaft 30. The first shaft hole 73 extends towards the one end of the input shaft 30. The first transmission rotor 70 is located between the one end of the input shaft 30 and the first ratchet element 40.

Two opposite sides of an inner wall of the first shaft hole 73 of the first transmission rotor 70 protrude face to face to form two first clamping surfaces 74. The two first clamping surfaces 74 are disposed vertically. The two first clamping surfaces 74 face each other. The two first clamping surfaces 74 are parallel with each other. The two first clamping surfaces 74 are formed on an inner surface of a peripheral wall of the first shaft hole 73. A distance between the two first clamping surfaces 74 is less than or equal to an outer diameter of the first hollow shaft 41. The first hollow shaft 41 is pivotally connected to the first transmission rotor 70. The two first clamping surfaces 74 are interfered with the first hollow shaft 41. When the first hollow shaft 41 is pivotally mounted in the first shaft hole 73 of the first transmission rotor 70, the first hollow shaft 41 is tightly mated with the first shaft hole 73 by the two first clamping surfaces 74. Therefore, when a first driving force is acted upon the first ratchet element 40 or the first transmission rotor 70, the first ratchet element 40 and the first transmission rotor 70 rotate synchronously, nevertheless, when the first driving force acted upon the first ratchet element 40 or the first transmission rotor 70 is more than a first threshold value, the first ratchet element 40 and the first transmission rotor 70 stop rotating synchronously.

The fastening structure 10 has a second hollow shaft 11. The second hollow shaft 11 extends along the axis direction of the input shaft 30. The second hollow shaft 11 of the fastening structure 10 is mounted around the one end of the input shaft 30. The fastening structure 10 is disposed in the other end of the pickup roller 20. The second hollow shaft 11 extends towards the second ratchet element 50 which is received in the other end of the pickup roller 20.

A middle of the second transmission rotor 80 has a second shaft hole 83. The second shaft hole 83 extends along the axis direction of the input shaft 30. The second shaft hole 83 penetrates through two opposite ends of the second transmission rotor 80. The second transmission rotor 80 is located between the actuating unit 60 and the pickup roller 20. Two opposite sides of an inner wall of the second shaft hole 83 of the second transmission rotor 80 protrude face to face to form two second clamping surfaces 84. The two opposite second clamping surfaces 84 are formed on an inner surface of a peripheral wall of the second shaft hole 83. A distance between the two second clamping surfaces 84 is less than or equal to an outer diameter of the second hollow shaft 11.

The two second clamping surfaces 84 are interfered with the second hollow shaft 11. The second hollow shaft 11 is pivotally connected to the second transmission rotor 80. When the second hollow shaft 11 is pivotally mounted in the second shaft hole 83 of the second transmission rotor 80, the second hollow shaft 11 is tightly mated with the second shaft hole 83 by the two second clamping surfaces 84. Therefore, when a second driving force is acted upon the second transmission rotor 80 is less than a second threshold value, the fastening structure 10 blocks the second transmission rotor 80, so that the second transmission rotor 80 stops rotating. When the second driving force acted upon the second transmission rotor 80 is greater than the second threshold value, the second transmission rotor 80 starts rotating.

Figure 3:
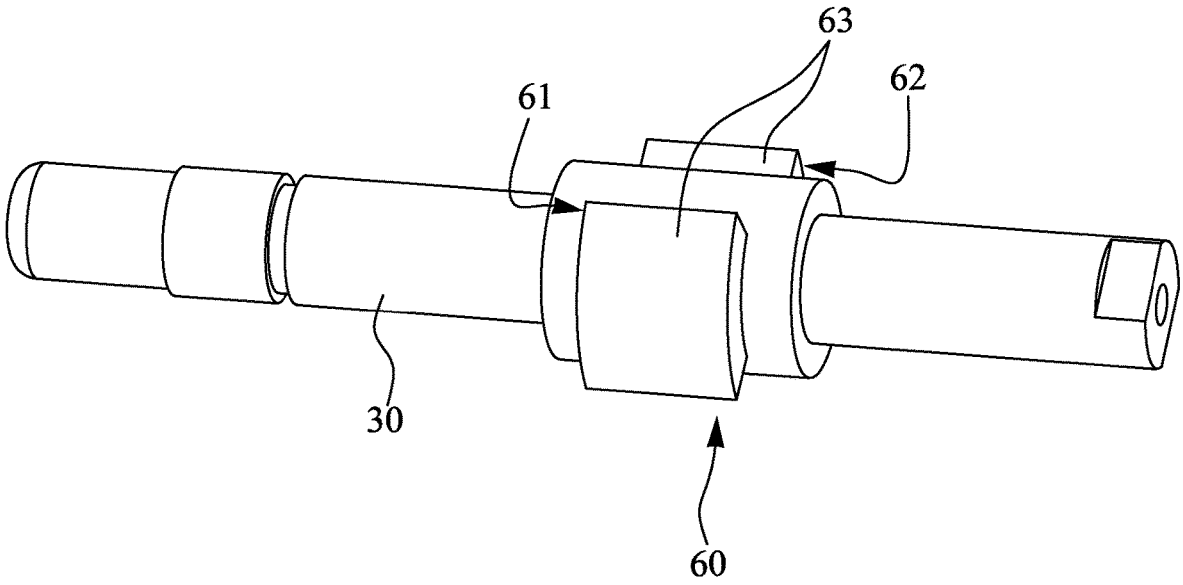
FIG. 3 is a perspective view of an input shaft of the bi-directional paper pickup mechanism in accordance with the present invention.
Figure 4:
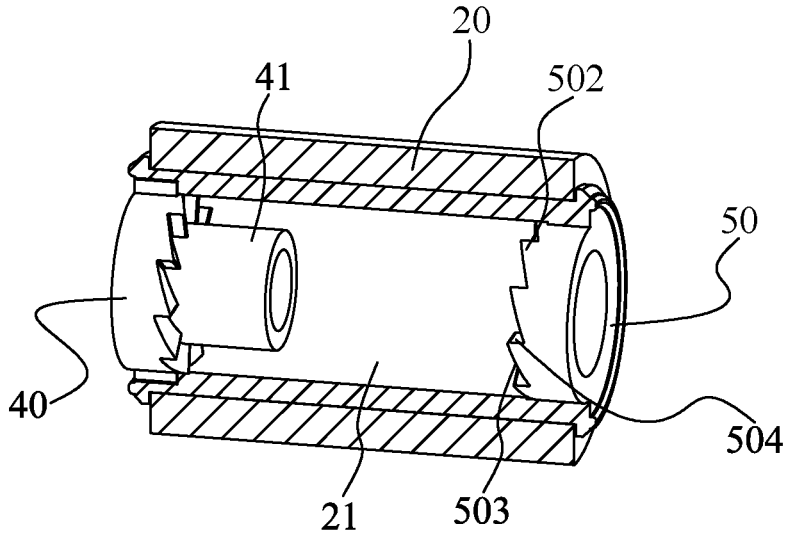
FIG. 4 is a partially sectional view of the bi-directional paper pickup mechanism showing a pickup roller, a first ratchet element and a second ratchet element of the bi-directional paper pickup mechanism in accordance with the present invention.
Figure 5:
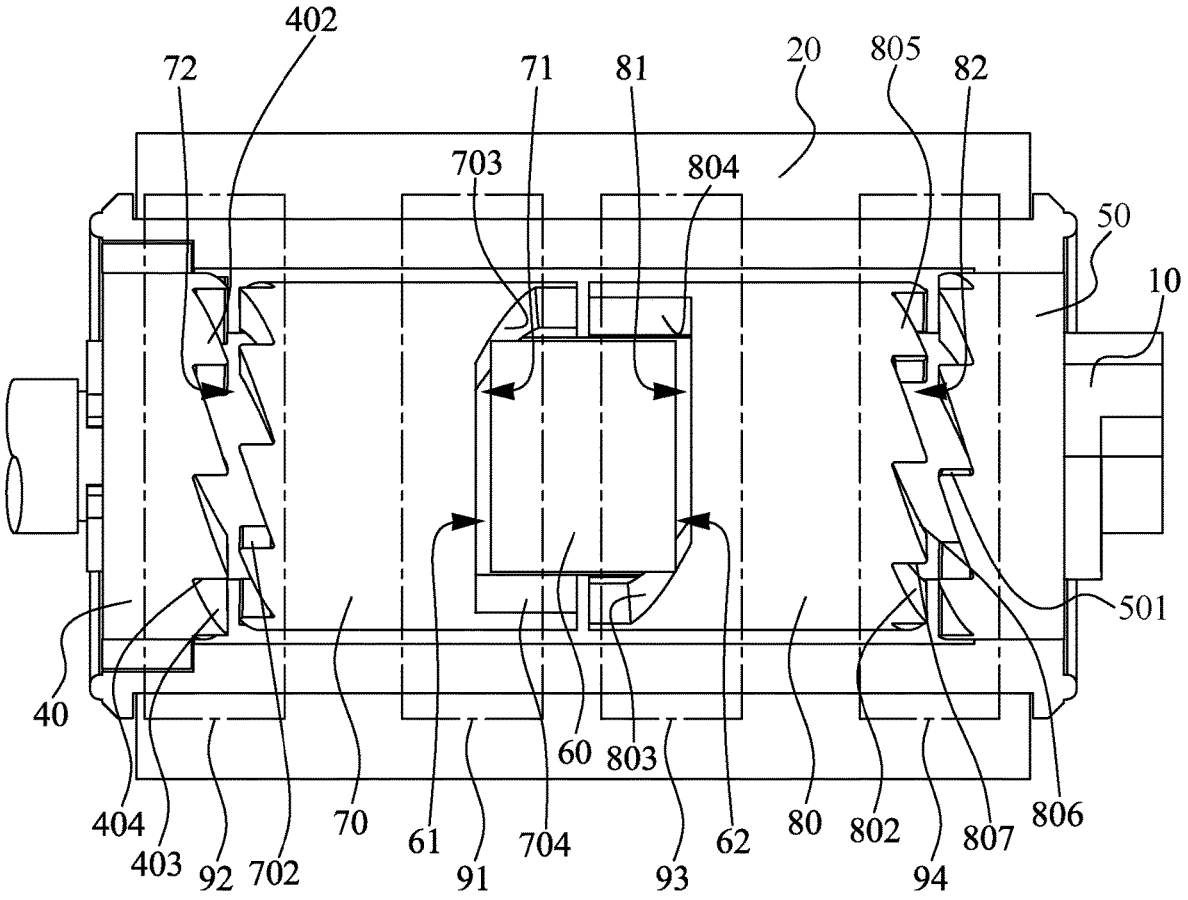
FIG. 5 is another partially sectional view of the bi-directional paper pickup mechanism in accordance with the present invention.

Referring to FIG. 3 and FIG. 5, in order to make the bi-directional paper pickup mechanism 100 have a function of automatically controlling a transmission mode of the driving force, one end of the bi-directional paper pickup mechanism 100 has a first conversion unit 91 and a second conversion unit 92, and the other end of the bi-directional paper pickup mechanism 100 has a third conversion unit 93 and a fourth conversion unit 94. Two opposite end surfaces of the first transmission rotor 70 along the axis direction of the input shaft 30 are defined as a first transmission surface 701 and a second transmission surface 702. The first actuating end 71 has the first transmission surface 701, and the first ratchet end 72 has the second transmission surface 702. The second transmission surface 702 is opposite to the first transmission surface 701. The first actuating surface 61 and the first actuating end 71 are cooperated to form the first conversion unit 91. The first transmission surface 701 of the first transmission rotor 70 is cooperated with the first actuating surface 61 of the actuating unit 60 to form the first conversion unit 91. The second transmission surface 702 of the first transmission rotor 70 is cooperated with the inner end surface 401 of the first ratchet element 40 to form the second conversion unit 92.

Two opposite end surfaces of the second transmission rotor 80 along the axis direction of the input shaft 30 are defined as a first coupling surface 801 and a second coupling surface 802. The second coupling surface 802 is opposite to the first coupling surface 801. The first coupling surface 801 of the second transmission rotor 80 is cooperated with the second actuating surface 62 of the actuating unit 60 to form the third conversion unit 93. The second coupling surface 802 of the second transmission rotor 80 is cooperated with the inner end surface 501 of the second ratchet element 50 to form the fourth conversion unit 94. The first conversion unit 91, the second conversion unit 92, the third conversion unit 93 and the fourth conversion unit 94 convert rotation motions of the first transmission rotor 70 and the second transmission rotor 80 around the axis direction of the input shaft 30 to horizontal movements of the first transmission rotor 70 and the second transmission rotor 80 along the axis direction of the input shaft 30, so that a motive force transmission among the first transmission rotor 70, the second transmission rotor 80 and the pickup roller 20 is controlled.

The actuating unit 60 has two actuating blocks 63. In specific, two sides of an outer surface of the actuating unit 60 protrude outward to form the two actuating blocks 63. The two actuating blocks 63 are disposed symmetrically along the axis direction of the input shaft 30. The actuating unit 60 is shown as a cylinder shape. The two actuating blocks 63 extend along the outer surface of the actuating unit 60. Two sides of an inner surface of the first actuating end 71 protrude towards the first actuating surface 61 of the actuating unit 60 to form two first transmission blocks 711. The two first transmission blocks 711 are disposed symmetrically along the axis direction of the input shaft 30. The first actuating surface 61 includes one end surface of each actuating block 63 and one end of one side surface of each actuating block 63 which face towards the first transmission rotor 70. The second actuating surface 62 includes the other end surface of each actuating block 63 and the other end of the other side surface of each actuating block 63 which face towards the second transmission rotor 80.

When the two actuating blocks 63 rotate towards the paper feeding direction, two surfaces of the two first transmission blocks 711 which contact with the two actuating blocks 63 are defined as two first inclined surfaces 703, when the two actuating blocks 63 rotate towards the paper receding direction, another two surfaces of the two first transmission blocks 711 which contact with the two actuating blocks 63 are defined as two first step-shaped surfaces 704. A junction between the inner surface of the first actuating end 71 and one side surface of each first transmission block 711 defines the first inclined surface 703. The first inclined surface 703 slantwise extends outward from one end of the first inclined surface 703 which is connected with a middle of the one side surface of each first transmission block 711 to the other end of the first inclined surface 703 which is connected with the inner surface of the first actuating end 71. The other side surface of each first transmission block 711 is perpendicular to the inner surface of the first actuating end 71 to be defined as the first step-shaped surface 704. The first transmission surface 701 includes the first inclined surface 703 and the first step-shaped surface 704.

When the actuating unit 60 of the input shaft 30 rotates towards the paper feeding direction, the two actuating blocks 63 rotate towards the paper feeding direction, the first inclined surface 703 of each first transmission block 711 contacts with one actuating block 63, the first inclined surface 703 of each first transmission block 711 abuts against the first actuating surface 61, the first transmission rotor 70 rotates towards the paper feeding direction. When the actuating unit 60 rotates towards the paper receding direction, the two actuating blocks 63 rotate towards the paper receding direction, the first step-shaped surface 704 contacts with the other actuating block 63, the first step-shaped surface 704 abuts against the first actuating surface 61.

The first ratchet element 40 is cooperated with the first ratchet end 72 to form the second conversion unit 92. The inner end surface 401 of the first ratchet element 40 which is adjacent to the first ratchet end 72 is a circular ratchet surface, and the circular ratchet surface is formed continuously around the axis direction of the input shaft 30. The second transmission surface 702 of the first ratchet end 72 is the circular ratchet surface which is formed continuously around the axis direction of the input shaft 30.

The first ratchet end 72 has a plurality of first teeth 705. Two opposite side surfaces of each first tooth 705 have a second inclined surface 706 and a second step-shaped surface 707. The second transmission surface 702 includes a plurality of the second inclined surfaces 706 and the second step-shaped surfaces 707 of the plurality of the first teeth 705. The first ratchet element 40 has a plurality of second teeth 402. The plurality of the second teeth 402 surround an inner end of the first hollow shaft 41. Two opposite side surfaces of each second tooth 402 have a third inclined surface 403 and a third step-shaped surface 404. The third inclined surface 403 is matched with the second inclined surface 706. The third step-shaped surface 404 is matched with the second step-shaped surface 707.

When the first transmission rotor 70 rotates towards the paper feeding direction, the first transmission rotor 70 moves towards the first ratchet element 40 under an action of the first conversion unit 91, surfaces of the first ratchet end 72 which contact with the first ratchet element 40 are defined as the second step-shaped surfaces 707 and the second inclined surfaces 706, the second step-shaped surfaces 707 of the plurality of the first teeth 705 of the first ratchet end 72 of the first transmission rotor 70 contact with the third step-shaped surfaces 404 of the plurality of the second teeth 402 of the first ratchet element 40, and the second inclined surfaces 706 of the plurality of the first teeth 705 of the first transmission rotor 70 contact with the third inclined surfaces 403 of the plurality of the second teeth 402 of the first ratchet element 40.

Figure 6:
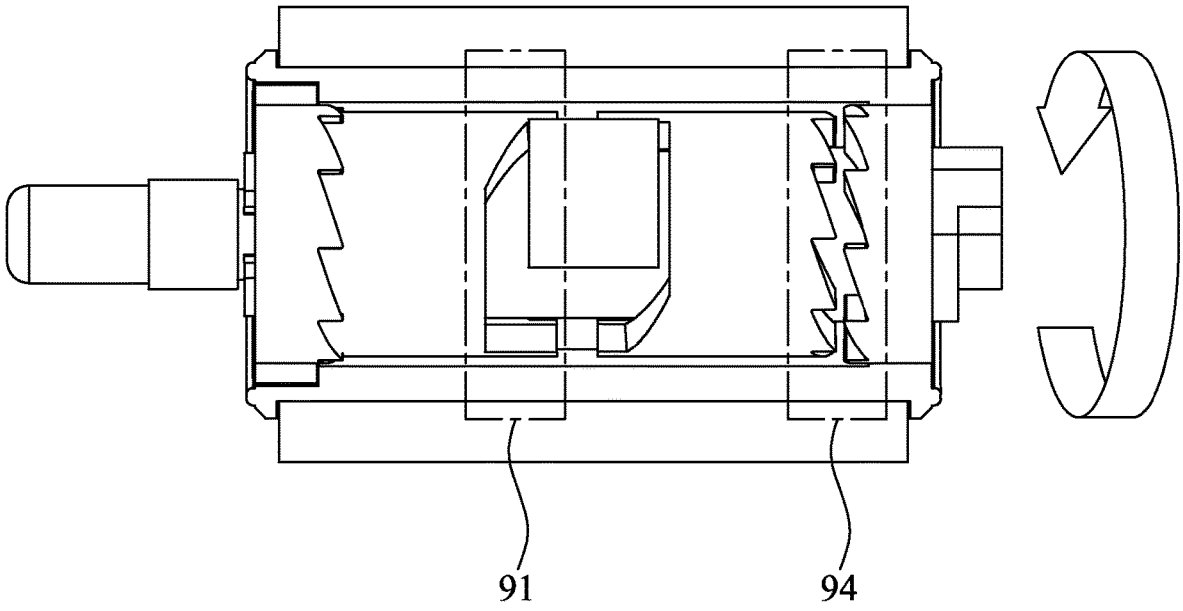
FIG. 6 is a schematic diagram showing that an actuation status of the input shaft rotating towards a paper feeding direction of the bi-directional paper pickup mechanism in accordance with the present invention.
Figure 7:
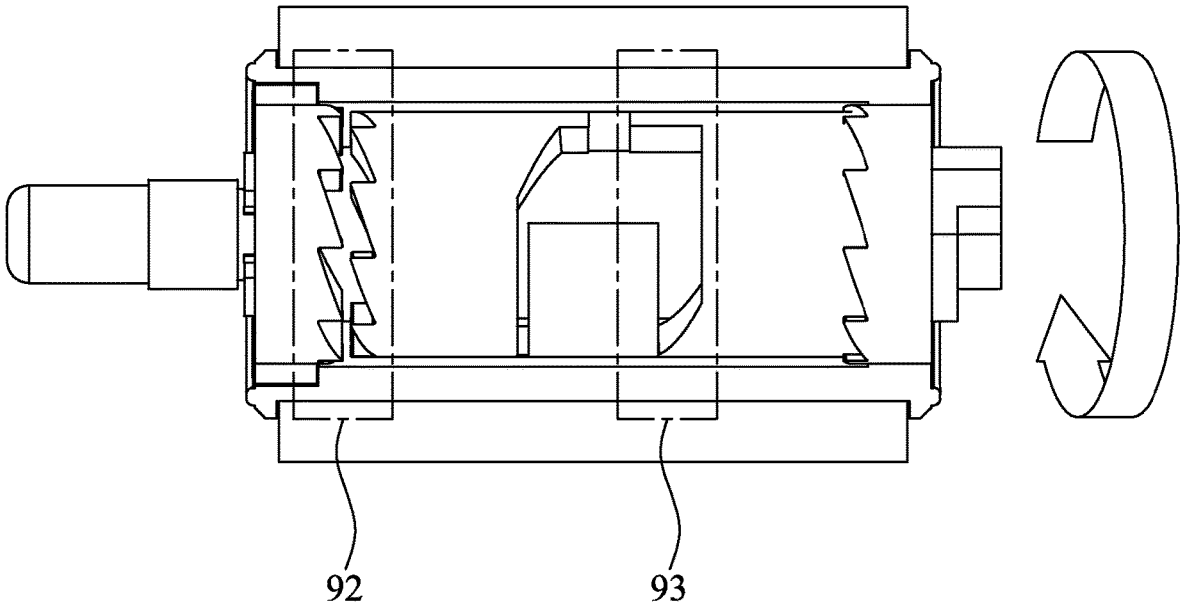
FIG. 7 is a schematic diagram showing that an actuation status of the input shaft rotating towards a paper receding direction of the bi-directional paper pickup mechanism in accordance with the present invention.
Figure 8:
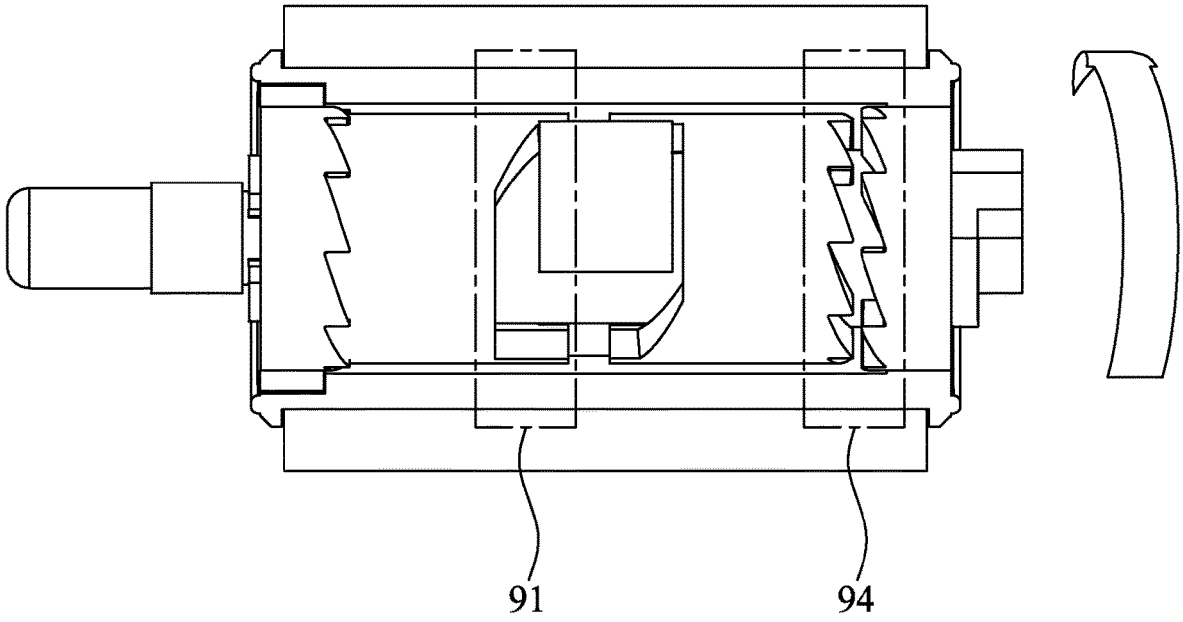
FIG. 8 is a schematic diagram showing that shows an actuation status of the bi-directional paper pickup mechanism feeding paper in the paper feeding direction of the bi-directional paper pickup mechanism in accordance with the present invention.
Figure 9:
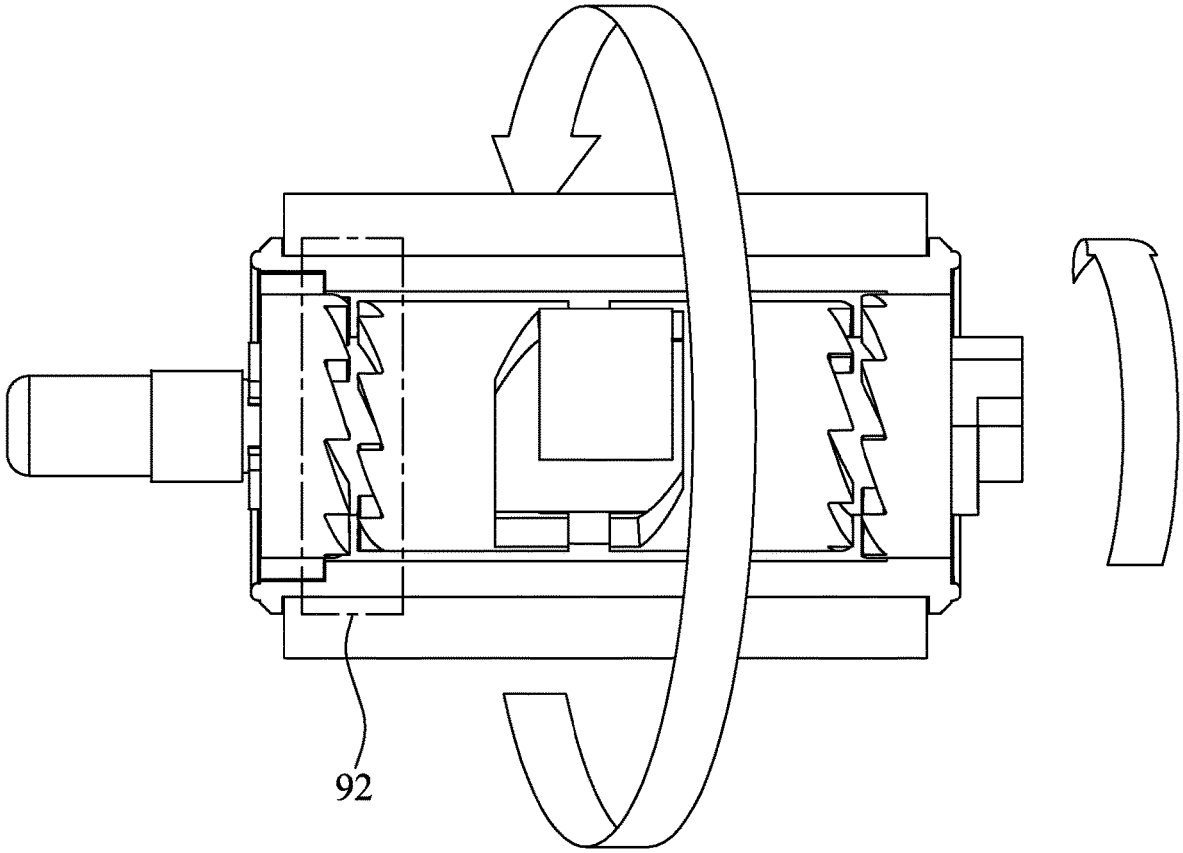
FIG. 9 is a schematic diagram showing that an actuation status of the pickup roller being pulled towards the paper feeding direction of the bi-directional paper pickup mechanism in accordance with the present invention.
Figure 10:
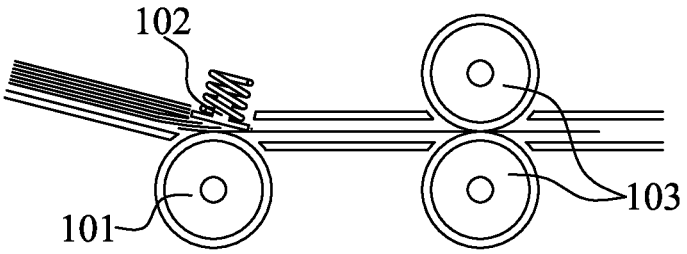
FIG. 10 (Prior Art)
FIG. 10 is a schematic diagram of a conventional paper pickup mechanism in prior art.

Referring to FIG. 6 and FIG. 7, the first transmission rotor 70 slides towards different directions according to a rotating direction of the input shaft 30. When the input shaft 30 rotates in the paper feeding direction, and the paper is fed towards the pickup roller 20, the input shaft 30 drives the two first transmission blocks 711 of the first transmission rotor 70 to rotate, then the input shaft 30 pushes the first transmission rotor 70 to move towards the first ratchet element 40 under the action of the first conversion unit 91, the first transmission rotor 70 is engaged with the first ratchet element 40 by virtue of the plurality of the first teeth 705 being engaged with the plurality of the second teeth 402, so the first driving force along the paper feeding direction is transmitted to the pickup roller 20. After the paper is transmitted to the pickup roller 20, the first transmission rotor 70 breaks away from the first ratchet element 40, the first ratchet element 40 stops rotating. The second transmission rotor 80 is without contacting with the second ratchet element 50, the second ratchet element 50 stops rotating.

When the input shaft 30 rotates towards the paper receding direction, the two first transmission blocks 711 of the first transmission rotor 70 rotate towards the paper receding direction, at the moment, the input shaft 30 drives the first ratchet element 40 to push the first transmission rotor 70 away from the first ratchet element 40 under an action of the second conversion unit 92, so the first ratchet element 40 is separated from the first transmission rotor 70, and then the first driving force along the paper receding direction is blocked from being transmitted to the pickup roller 20. The input shaft 30 drives the second transmission rotor 80 to move towards the second ratchet element 50, the second transmission rotor 80 is engaged with the second ratchet element 50, so the second ratchet element 50 drives the pickup roller 20 to rotate towards the paper receding direction to recede the paper.

The second actuating surface 62 is cooperated with the second actuating end 81 to form the third conversion unit 93. The second actuating end 81 has two second transmission blocks 811. Two portions of an inner surface of the second actuating end 81 protrude outward to form the two second transmission blocks 811. The two second transmission blocks 811 are disposed symmetrically along the axis direction of the input shaft 30.

When the two actuating blocks 63 rotate towards the paper feeding direction, two surfaces of the two second transmission blocks 811 which contact with the two actuating blocks 63 are defined as two fourth step-shaped surfaces 804. When the two actuating blocks 63 rotate towards the paper receding direction, another two surfaces of the two second transmission blocks 811 which contact with the two actuating blocks 63 are defined as two fourth inclined surfaces 803. A junction between the inner surface of the second actuating end 81 and one side surface of each second transmission block 811 defines the fourth inclined surface 803. The fourth inclined surface 803 slantwise extends outward from one end of the fourth inclined surface 803 which is connected with a middle of the one side surface of each second transmission block 811 to the other end of the fourth inclined surface 803 which is connected with the inner surface of the second actuating end 81. The other side surface of each second transmission block 811 is perpendicular to the inner surface of the second actuating end 81 to be defined as the fourth step-shaped surface 804. The first coupling surface 801 includes the fourth inclined surface 803 and the fourth step-shaped surface 804.

When the actuating unit 60 of the input shaft 30 rotates towards the paper feeding direction, the two actuating blocks 63 rotate towards the paper feeding direction, the fourth step-shaped surface 804 of each second transmission block 811 contacts with the one actuating block 63, the fourth step-shaped surface 804 of each second transmission block 811 abuts against the second actuating surface 62, the second transmission rotor 80 breaks away from the second ratchet element 50 under an action of the third conversion unit 93. When the actuating unit 60 rotates towards the paper receding direction, the two actuating blocks 63 rotate towards the paper receding direction, the fourth inclined surface 803 of each second transmission block 811 contacts with the other actuating block 63 under the action of the third conversion unit 93, the fourth inclined surface 803 of each second transmission block 811 abuts against the second actuating surface 62, the second transmission rotor 80 is engaged with the second ratchet element 50.

The second ratchet element 50 is cooperated with the second ratchet end 82 to form the fourth conversion unit 94. The inner end surface 501 of the second ratchet element 50 is the circular ratchet surface which is formed continuously around the axis direction of the input shaft 30. The second coupling surface 802 of the second ratchet end 82 is the circular ratchet surface which is formed continuously around the axis direction of the input shaft 30.

When the second transmission rotor 80 rotates towards the paper receding direction, surfaces of the second ratchet end 82 are defined as a plurality of fifth inclined surfaces 806 and fifth step-shaped surfaces 807. The second ratchet end 82 has a plurality of third teeth 805. Two opposite side surfaces of each third tooth 805 have the fifth inclined surface 806 and the fifth step-shaped surface 807. The second coupling surface 802 includes a plurality of the fifth inclined surfaces 806 and the fifth step-shaped surfaces 807 of the plurality of the third teeth 805. The second ratchet element 50 has a plurality of fourth teeth 502. Two opposite side surfaces of each fourth tooth 502 have a sixth inclined surface 503 and a sixth step-shaped surface 504. The sixth inclined surface 503 is matched with the fifth inclined surface 806. The sixth step-shaped surface 504 is matched with the fifth step-shaped surface 807.

When the input shaft 30 rotates towards the paper feeding direction, the two second transmission blocks 811 rotate towards the paper feeding direction, and the second transmission rotor 80 rotates towards the paper feeding direction, the plurality of the fifth inclined surfaces 806 of the second ratchet end 82 contact with the plurality of the sixth inclined surfaces 503 of the second ratchet element 50. When the input shaft 30 rotates towards the paper receding direction, the two second transmission blocks 811 rotate towards the paper receding direction, and the second transmission rotor 80 rotates towards the paper receding direction, the plurality of the fifth step-shaped surfaces 807 of the second ratchet end 82 contact with the plurality of the sixth step-shaped surfaces 504 of the second ratchet element 50. The input shaft 30 drives the first transmission rotor 70 to rotate towards the paper receding direction, the first transmission rotor 70 breaks away from the first ratchet element 40 under the action of the second conversion unit 92, so the first ratchet element 40 is separated from the first transmission rotor 70, and then the first driving force along the paper receding direction is blocked from being transmitted to the pickup roller 20. The input shaft 30 drives the second transmission rotor 80 to move towards the second ratchet element 50 under an action of the fourth conversion unit 94, the second transmission rotor 80 is engaged with the second ratchet element 50, so the pickup roller 20 rotates towards the paper receding direction to recede the paper.

Referring to FIG. 1 to FIG. 7, the second transmission rotor 80 slides in different directions according to rotating directions of the input shaft 30. When the input shaft 30 rotates towards the paper feeding direction, the two second transmission blocks 811 rotate towards the paper feeding direction to drive the second transmission rotor 80 to rotate towards the paper feeding direction, at the moment, the second transmission rotor 80 is pushed to break away from the second ratchet element 50 under the action of the fourth conversion unit 94, so the second transmission rotor 80 is separated from the second ratchet element 50, and then the second driving force along the paper receding direction is blocked from being transmitted to the pickup roller 20. On the contrary, when the input shaft 30 rotates in the paper receding direction, the two second transmission blocks 811 rotate towards the paper receding direction, the actuating unit 60 pushes the second transmission rotor 80 to move towards the second ratchet element 50 under the action of the third conversion unit 93, the second transmission rotor 80 is engaged with the second ratchet element 50 under the action of the fourth conversion unit 94, so the second driving force along the paper receding direction is transmitted to the pickup roller 20, and the pickup roller 20 rotates towards the paper receding direction to recede the paper.

When the input shaft 30 rotates towards the paper feeding direction or the paper receding direction, the driving force is transmitted to the pickup roller 20 by the actions of the first conversion unit 91, the second conversion unit 92, the third conversion unit 93 and the fourth conversion unit 94. The driving force is the first driving force or the second driving force.

The driving force inputted by the input shaft 30 is transmitted to the pickup roller 20, and simultaneously, a transmission force inputted by the pickup roller 20 is blocked from being transmitted to the input shaft 30 by the actions of the first conversion unit 91, the second conversion unit 92, the third conversion unit 93 and the fourth conversion unit 94. So the bi-directional paper pickup mechanism 100 changes a power transmitting status between the input shaft 30 and the pickup roller 20, and the bi-directional paper pickup mechanism 100 transmits the driving force from a clockwise rotation or an anticlockwise rotation of the input shaft 30 to the pickup roller 20, and blocks the transmission force from the pickup roller 20 by virtue of making the pickup roller 20 idle.

Referring to FIG. 1 to FIG. 8, when the pickup roller 20 picks up the paper, the first transmission rotor 70 is pushed to be engaged with the first ratchet element 40 by the action of the first conversion unit 91, and simultaneously, the second transmission rotor 80 is pushed away from the second ratchet element 50 by the action of the fourth conversion unit 94 to be separated from the second ratchet element 50. When the input shaft 30 rotates towards the paper feeding direction, the first actuating surface 61 rotates along the first actuating end 71 to push the first transmission rotor 70 to move towards the first ratchet element 40, the first ratchet end 72 is matched with the first ratchet element 40, the second actuating end 81 abuts against the second actuating surface 62, the second transmission rotor 80 breaks away from the second ratchet element 50.

Referring to FIG. 1 to FIG. 9, when the pickup roller 20 feeds the paper, the pickup roller 20 is pulled by other downstream rollers (not shown), the pickup roller 20 and the input shaft 30 rotate towards the paper feeding direction, and an angular speed of the pickup roller 20 is faster than an angular speed of the input shaft 30. The first transmission rotor 70 is pushed away from the first ratchet element 40 under the action of the second conversion unit 92 to separate the first transmission rotor 70 from the first ratchet element 40, so that the transmission force in the paper feeding direction is blocked from being transmitted to the input shaft 30. Because the second transmission rotor 80 is separated from the second ratchet element 50, the second transmission rotor 80 is without being affected by a faster rotation speed of the pickup roller 20, and the second transmission rotor 80 and the second ratchet element 50 remain a separation status. The pickup roller 20 idles under a traction of the downstream rollers, and the paper is pulled to be accelerated. Thus, the bi-directional paper pickup mechanism 100 idles at the time of the paper being pulled to be accelerated, and simultaneously, the bi-directional paper pickup mechanism 100 is able to bidirectionally feed the paper upstream and downstream.

When the input shaft 30 rotates towards the paper receding direction, the first actuating end 71 abuts against the first actuating surface 61, the first transmission rotor 70 breaks away from the first ratchet element 40, the second actuating surface 62 rotates along the second actuating end 81 to push the second transmission rotor 80 to move towards the second ratchet element 50, the second ratchet end 82 is matched with the second ratchet element 50.

As described above, the pickup roller 20 feeds the paper or recedes the paper by the actions of the first conversion unit 91, the second conversion unit 92, the third conversion unit 93 and the fourth conversion unit 94, so the bi-directional paper pickup mechanism 100 is able to bidirectionally feed the paper upstream and downstream.

What is claimed is:

1. A bi-directional paper pickup mechanism, comprising:

a pickup roller, an inside of the pickup roller having an inner space extending along an axis direction of the pickup roller, the inner space penetrating through two opposite ends of the pickup roller;

a fastening structure disposed in the inner space;

an input shaft accommodated in the inner space, and one end of the input shaft being pivotally connected to the fastening structure;

a first ratchet element mounted around the input shaft, the other end of the input shaft and the first ratchet element being fastened to one end of the pickup roller;

a second ratchet element mounted around the one end of the input shaft, the one end of the input shaft and the second ratchet element being fastened to the other end of the pickup roller;

an actuating unit fastened around a middle of the input shaft to synchronously rotate with the input shaft, the actuating unit having a first actuating surface and a second actuating surface;

a first transmission rotor mounted around the one end of the input shaft, and the first transmission rotor being positioned between the first ratchet element and the first actuating surface, two opposite ends of the first transmission rotor having a first actuating end and a first ratchet end, the first actuating end being disposed adjacent to the first actuating surface, the first ratchet end being disposed adjacent to an inner end surface of the first ratchet element; and a second transmission rotor mounted around the other end of the input shaft, the second transmission rotor being positioned between the second ratchet element and the second actuating surface, two opposite ends of the second transmission rotor having a second actuating end and a second ratchet end, the second actuating end being disposed adjacent to the second actuating surface, the second ratchet end being disposed adjacent to an inner end surface of the second ratchet element, wherein the first actuating surface and the first actuating end are cooperated to form a first conversion unit, when the input shaft rotates towards a paper feeding direction, the first transmission rotor rotates towards the paper feeding direction, the first transmission rotor moves towards the first ratchet element under an action of the first conversion unit, wherein the first ratchet element is cooperated with the first ratchet end to form a second conversion unit, when the input shaft rotates towards a paper receding direction, the input shaft drives the first transmission rotor to rotate towards the paper receding direction, the first transmission rotor breaks away from the first ratchet element under an action of the second conversion unit, wherein the second actuating surface is cooperated with the second actuating end to form a third conversion unit, when the input shaft rotates towards the paper feeding direction, the second transmission rotor breaks away from the second ratchet element under an action of the third conversion unit, and wherein the second ratchet element is cooperated with the second ratchet end to form a fourth conversion unit, when the input shaft rotates towards the paper receding direction, the input shaft drives the second transmission rotor to move towards the second ratchet element under an action of the fourth conversion unit, the second transmission rotor is engaged with the second ratchet element.

2. The bi-directional paper pickup mechanism as claimed in claim 1, wherein the inner end surface of the first ratchet element which is adjacent to the first ratchet end is a circular ratchet surface, and the circular ratchet surface is formed continuously around an axis direction of the input shaft, the first actuating end has a first transmission surface, and the first ratchet end has a second transmission surface, the second transmission surface is opposite to the first transmission surface, the second transmission surface is the circular ratchet surface which is formed continuously around the axis direction of the input shaft.

3. The bi-directional paper pickup mechanism as claimed in claim 2, wherein two sides of an outer surface of the actuating unit protrude outward to form two actuating blocks, the two actuating blocks are disposed symmetrically along the axis direction of the input shaft, the first actuating surface includes one end surface of each actuating block and one end of one side surface of each actuating block which face towards the first transmission rotor, the second actuating surface includes the other end surface of each actuating block and the other end of the other side surface of each actuating block which face towards the second transmission rotor.

4. The bi-directional paper pickup mechanism as claimed in claim 3, wherein two sides of an inner surface of the first actuating end protrude towards the first actuating surface to form two first transmission blocks, the two first transmission blocks are disposed symmetrically along the axis direction of the input shaft, when the two actuating blocks rotate towards the paper feeding direction, two surfaces of the two first transmission blocks which contact with the two actuating blocks are defined as two first inclined surfaces, when the two actuating blocks rotate towards the paper receding direction, another two surfaces of the two first transmission blocks which contact with the two actuating blocks are defined as two first step-shaped surfaces.

5. The bi-directional paper pickup mechanism as claimed in claim 4, wherein a junction between the inner surface of the first actuating end and one side surface of each first transmission block defines the first inclined surface, the first inclined surface slantwise extends outward from one end of the first inclined surface which is connected with a middle of the one side surface of each first transmission block to the other end of the first inclined surface which is connected with the inner surface of the first actuating end, the other side surface of each first transmission block is perpendicular to the inner surface of the first actuating end to be defined as the first step-shaped surface, the first transmission surface includes the first inclined surface and the first step-shaped surface.

6. The bi-directional paper pickup mechanism as claimed in claim 5, wherein when the first transmission rotor rotates towards the paper feeding direction, surfaces of the first ratchet end which contact with the first ratchet element are defined as second step-shaped surfaces and second inclined surfaces, the first ratchet end has a plurality of first teeth, two opposite side surfaces of each first tooth have the second inclined surface and the second step-shaped surface.

7. The bi-directional paper pickup mechanism as claimed in claim 6, wherein the first ratchet element has a plurality of second teeth, two opposite side surfaces of each second tooth have a third inclined surface and a third step-shaped surface, the third inclined surface is matched with the second inclined surface, the third step-shaped surface is matched with the second step-shaped surface.

8. The bi-directional paper pickup mechanism as claimed in claim 7, wherein two portions of an inner surface of the second actuating end protrude outward to form two second transmission blocks, the two second transmission blocks are disposed symmetrically along the axis direction of the input shaft, when the two actuating blocks rotate towards the paper feeding direction, two surfaces of the two second transmission blocks which contact with the two actuating blocks are defined as two fourth step-shaped surfaces, when the two actuating blocks rotate towards the paper receding direction, another two surfaces of the two second transmission blocks which contact with the two actuating blocks are defined as two fourth inclined surfaces.

9. The bi-directional paper pickup mechanism as claimed in claim 8, wherein a junction between the inner surface of the second actuating end and one side surface of each second transmission block defines the fourth inclined surface, the fourth inclined surface slantwise extends outward from one end of the fourth inclined surface which is connected with a middle of the one side surface of each second transmission block to the other end of the fourth inclined surface which is connected with the inner surface of the second actuating end, the other side surface of each second transmission block is perpendicular to the inner surface of the second actuating end to be defined as the fourth step-shaped surface.

10. The bi-directional paper pickup mechanism as claimed in claim 9, wherein the inner end surface of the second ratchet element is a circular ratchet surface which is formed continuously around the axis direction of the input shaft, two opposite end surfaces of the second transmission rotor along the axis direction of the input shaft are defined as a first coupling surface and a second coupling surface, the second coupling surface is opposite to the first coupling surface, the second coupling surface of the second ratchet end is the circular ratchet surface which is formed continuously around the axis direction of the input shaft, the first coupling surface includes the fourth inclined surface and the fourth step-shaped surface.

11. The bi-directional paper pickup mechanism as claimed in claim 10, wherein when the second transmission rotor rotates towards the paper receding direction, surfaces of the second ratchet end are defined as a plurality of fifth inclined surfaces and fifth step-shaped surfaces.

12. The bi-directional paper pickup mechanism as claimed in claim 11, wherein the second ratchet end has a plurality of third teeth, two opposite side surfaces of each third tooth have a fifth inclined surface and a fifth step-shaped surface, the second coupling surface includes a plurality of the fifth inclined surfaces and the fifth step-shaped surfaces, the second ratchet element has a plurality of fourth teeth, two opposite side surfaces of each fourth tooth have a sixth inclined surface and a sixth step-shaped surface, the sixth inclined surface is matched with the fifth inclined surface, the sixth step-shaped surface is matched with the fifth step-shaped surface.

13. The bi-directional paper pickup mechanism as claimed in claim 1, wherein the first ratchet element includes a first hollow shaft, the first hollow shaft extends towards the one end of the input shaft, the first hollow shaft extends along an axis direction of the input shaft, the first transmission rotor has a first shaft hole transversely penetrating through two opposite ends of the first transmission rotor, the first shaft hole extends along the axis direction of the input shaft, the first hollow shaft is pivotally mounted in the first shaft hole, the first hollow shaft is tightly mated with the first shaft hole.

14. The bi-directional paper pickup mechanism as claimed in claim 13, wherein two opposite sides of an inner wall of the first shaft hole of the first transmission rotor protrude face to face to form two first clamping surfaces, a distance between the two first clamping surfaces is less than or equal to an outer diameter of the first hollow shaft.

15. The bi-directional paper pickup mechanism as claimed in claim 14, wherein the fastening structure has a second hollow shaft, the second hollow shaft extends along the axis direction of the input shaft, the second hollow shaft extends towards the second ratchet element, the second transmission rotor has a second shaft hole, the second shaft hole extends along the axis direction of the input shaft, the second shaft hole penetrates through two opposite ends of the second transmission rotor, the second hollow shaft is pivotally mounted in the second shaft hole, the second hollow shaft is tightly mated with the second shaft hole.

16. The bi-directional paper pickup mechanism as claimed in claim 15, wherein two opposite sides of an inner wall of the second shaft hole of the second transmission rotor protrude face to face to form two second clamping surfaces, a distance between the two second clamping surfaces is less than or equal to an outer diameter of the second hollow shaft.

17. A bi-directional paper pickup mechanism, comprising:

a pickup roller, an inside of the pickup roller having an inner space penetrating through two opposite ends of the pickup roller;

an input shaft accommodated in the inner space, one end of the input shaft being received in the inner space;

a first ratchet element mounted around the other end of the input shaft, the other end of the input shaft and the first ratchet element being received in the inner space, the other end of the input shaft and the first ratchet element being fastened to one end of the pickup roller;

a second ratchet element mounted around the one end of the input shaft, the second ratchet element being received in the inner space, the one end of the input shaft and the second ratchet element being fastened to the other end of the pickup roller;

an actuating unit fastened around a middle of the input shaft to synchronously rotate with the input shaft, the actuating unit having a first actuating surface and a second actuating surface;

a first transmission rotor mounted around the one end of the input shaft, and the first transmission rotor being positioned between the first ratchet element and the first actuating surface, two opposite ends of the first transmission rotor having a first actuating end and a first ratchet end, the first actuating end being disposed adjacent to the first actuating surface, the first ratchet end being disposed adjacent to an inner end surface of the first ratchet element; and a second transmission rotor mounted around the other end of the input shaft, the second transmission rotor being positioned between the second ratchet element and the second actuating surface, two opposite ends of the second transmission rotor having a second actuating end and a second ratchet end, the second actuating end being disposed adjacent to the second actuating surface, the second ratchet end being disposed adjacent to an inner end surface of the second ratchet element, wherein when the input shaft rotates towards a paper feeding direction, the first actuating surface rotates along the first actuating end to push the first transmission rotor to move towards the first ratchet element, the first ratchet end is matched with the first ratchet element, the second actuating end abuts against the second actuating surface, the second transmission rotor breaks away from the second ratchet element, and wherein when the input shaft rotates towards a paper receding direction, the first actuating end abuts against the first actuating surface, the first transmission rotor breaks away from the first ratchet element, the second actuating surface rotates along the second actuating end to push the second transmission rotor to move towards the second ratchet element, the second ratchet end is matched with the second ratchet element.

18. A bi-directional paper pickup mechanism, comprising:

a pickup roller, an inside of the pickup roller having an inner space penetrating through two opposite ends of the pickup roller;

a fastening structure disposed in the inner space;

an input shaft accommodated in the inner space, and one end of the input shaft being pivotally connected to the fastening structure;

a first ratchet element mounted around the input shaft, the first ratchet element being fastened to one end of the pickup roller, the first ratchet element including a first hollow shaft, the first hollow shaft extending towards the one end of the input shaft;

a second ratchet element mounted around the one end of the input shaft, and the second ratchet element being fastened to the other end of the pickup roller, the fastening structure being disposed in the other end of the pickup roller;

an actuating unit fastened around a middle of the input shaft to synchronously rotate with the input shaft, the actuating unit having a first actuating surface and a second actuating surface;

a first transmission rotor mounted around the one end of the input shaft, and the first transmission rotor being positioned between the first ratchet element and the first actuating surface, two opposite ends of the first transmission rotor having a first actuating end and a first ratchet end, the first actuating end being disposed adjacent to the first actuating surface, the first ratchet end being disposed adjacent to an inner end surface of the first ratchet element, the first transmission rotor having a first shaft hole transversely penetrating through two opposite ends of the first transmission rotor, the first shaft hole extending along an axis direction of the input shaft, the first hollow shaft being pivotally mounted in the first shaft hole; and a second transmission rotor mounted around the other end of the input shaft, the second transmission rotor being positioned between the second ratchet element and the second actuating surface, two opposite ends of the second transmission rotor having a second actuating end and a second ratchet end, the second actuating end being disposed adjacent to the second actuating surface, the second ratchet end being disposed adjacent to an inner end surface of the second ratchet element, the fastening structure having a second hollow shaft, the second hollow shaft extending along the axis direction of the input shaft, the second transmission rotor having a second shaft hole, the second shaft hole extending along the axis direction of the input shaft, the second shaft hole penetrating through two opposite ends of the second transmission rotor, the second hollow shaft being pivotally mounted in the second shaft hole, wherein when the input shaft rotates towards a paper feeding direction, the first transmission rotor rotates towards the paper feeding direction, the first transmission rotor moves towards the first ratchet element, the second transmission rotor breaks away from the second ratchet element, and wherein when the input shaft rotates towards a paper receding direction, the input shaft drives the first transmission rotor to rotate towards the paper receding direction, the first transmission rotor breaks away from the first ratchet element, the input shaft drives the second transmission rotor to move towards the second ratchet element, the second transmission rotor is engaged with the second ratchet element.

* * * * *